US006238854B1

(12) United States Patent
Jansen et al.

(10) Patent No.: US 6,238,854 B1
(45) Date of Patent: May 29, 2001

(54) DEVELOPER COMPOSITION FOR USE IN THE PROCESSING OF LIGHT-SENSITIVE SILVER HALIDE PHOTOGRAPHIC MATERIALS

(75) Inventors: Benny Jansen, Geel; Govert De Baecke, Kalken; Frank Michiels, Arendonk; Johan Loccufier, Zwijnaarde; Ton Rutges, Boechout, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/588,226

(22) Filed: Jun. 6, 2000

Related U.S. Application Data

(60) Provisional application No. 60/143,647, filed on Jul. 14, 1999.

(30) Foreign Application Priority Data

Jun. 14, 1999 (EP) ..... 99201892

(51) Int. Cl.[7] ..... G03C 5/305
(52) U.S. Cl. ..... 430/488
(58) Field of Search ..... 430/488

(56) References Cited

U.S. PATENT DOCUMENTS

| | | | | |
|---|---|---|---|---|
| 3,628,955 | | 12/1971 | Haist et al. . | |
| 4,169,733 | | 10/1979 | Iytaka et al. . | |
| 4,254,215 | | 3/1981 | Kramp et al. . | |
| 5,510,231 | * | 4/1996 | Komatsu et al. | 430/488 |
| 5,725,998 | * | 3/1998 | Sanpei | 430/488 |
| 5,928,846 | * | 7/1999 | Yamashita et al. | 430/488 |
| 5,948,603 | * | 9/1999 | Uchihiro et al. | 430/488 |
| 6,013,423 | * | 1/2000 | Hirano et al. | 430/488 |

FOREIGN PATENT DOCUMENTS

| | | |
|---|---|---|
| 1 547 737 | 6/1970 | (DE) . |
| 0 032 456 A1 | 7/1981 | (EP) . |
| 1 401 112 | 7/1975 | (GB) . |
| 62-183455 | 8/1987 | (JP) . |

* cited by examiner

*Primary Examiner*—Hoa Van Le
(74) *Attorney, Agent, or Firm*—Breiner & Breiner

(57) ABSTRACT

A black-and-white silver halide developer composition has been disclosed comprising, besides one or more developing agent(s), agent(s) preventing oxidation thereof and agent(s) providing pH buffering, at least one silver complexing agent, characterized in that said silver complexing agent has a silver complexing stability ratio of at least 70% and, besides said silver complexing agent, at least one agent preventing silver dissolution characterized in that said agent preventing silver dissolution, if present in an amount of 50 mg/l of developer, makes silver content of the developer decrease in an amount of more than 50% versus in the absence thereof, without loss in speed in an amount of more than 0.10 log Exposure after processing in said developer composition.

11 Claims, No Drawings

DEVELOPER COMPOSITION FOR USE IN THE PROCESSING OF LIGHT-SENSITIVE SILVER HALIDE PHOTOGRAPHIC MATERIALS

The application claim the benefit of U.S. Provisional application No. 60/143,647 filed Jul. 14, 1999.

DESCRIPTION

1. Field of the Invention

The present invention relates to a developer composition having less tendency to sludge formation in the developing step of the processing of light-sensitive silver halide photographic materials.

2. Background of the Invention

Sludge formation in developers used in the processing of light-sensitive silver halide photographic materials is a well-known problem clients are confronted with. In the developer solution a deposit, known as silver sludge on the walls of the developer tank, on the rollers and on the racks are forming an ever lasting problem. In rinsing water microbiological growth is permanently causing dirt. Addition of fungicide-treated water as a solution proposed in U.S. Pat. No. 4,839,273 is however not always desired from an ecological point of view.

The presence of these undesired precipitates gives rise to failures on the processed film surface and, as a consequence thereof, to lowering of the diagnostic value of the obtained images and to the need to stop the machine in order to provide a long cleaning time, which is very expensive: silver sludge formed is not easy to oxidize as silver is a precious metal, requiring strong oxidants. As the well-known potassium bichromate is not desired from a point of view of ecology, weaker alternative oxidants are even taking longer times.

When a light-sensitive photographic silver halide material becomes processed, silver halide at the sites exposed by irradiation is transformed into metallic silver, catalyzed by the presence of latent image centers in the silver halide crystal, by the reducing compounds in the developer solution like hydroquinones, phenidones, ascorbic acid, reductic acid, etc. In order to provide rapid processing it is necessary to get a quick dissolution of the non-exposed silver halide, e.g. by the presence of sulfite in suitable amounts. In the developer however the dissolved silver halide becomes also (slowly) reduced into metallic silver nuclei, acting as a catalytic center stimulating further reduction of silver ions. Growth of those silver nuclei up to larger grey-black particles of more than 1 $\mu$m, together with coalescence and coagulation of smaller particles makes said particles form dirty flocculates, having the undesired effects of sludge formation mentioned hereinbefore.

Hitherto measures have been taken in order to dissolve lower amounts of unexposed silver halide in the developer, especially for crystals rich in silver chloride (see e.g. U.S. Pat. Nos. 5,641,620 and 5,707,793 and EP-A 0 851 282) as the solubility product of silver chloride is about 100 times the one of silver bromide. Use in the developer solution of lower amounts of e.g. sulfite, promoting dissolution of silver halides, is advantageous. This is however opposite to the advantage of rapid processing of film materials coated with light-sensitive layers having emulsion crystals rich in silver chloride and moreover, opposite to the thereby offered advantageous use of lower amounts of developer replenisher. A solution for the problem of sludge formation as has been set forth has e.g. been given in EP-A's 0 136 582, 0 223 883, 0 785 467 and 0 789 272 and in U.S. Pat. No. 5,240,823, wherein thioctic acid, polysulfide compounds having carboxylic acid, sulfonic acid, etc. and aminoalkane thiosulfonic acid or a salt thereof have been used.

Another measure applied in order to reach the same effects can be obtained by making use of a compound inhibiting dissolution by adsorption at the surface of the silver halide crystals. Protection of the said surface by adsorption effectively inhibits the dissolution of silver halide indeed, so that less silver ions are diffusing into the developer solution. A disadvantage however is the simultaneous inhibition of the velocity of the developing reaction so that a strong influence on sensitometry may occur in that speed, maximum density and contrast may be suppressed. Useful agents inhibiting dissolution of silver halide in a developer composition have been proposed as e.g. thioether compounds in U.S. Pat. No. 5,821,040; the mercapto-s-triazines from U.S. Pat. No. 5,300,410 and the mercapto or disulfide compounds in U.S. Pat. No. 5,364,746.

In spite of all measures silver ions may (and will) diffuse into the developer. In order to overcome the disadvantages already mentioned hereinbefore a suitable measure is to provide the presence of complexing agents into the said developer in order to occlude silver ions into a complex, forming a complex ion wherein the silver ions are protected against reduction by reducing developing agents. The said complex ion, opposite to silver metal formed by reduction, remains in the developer solution without causing sludge formation.

When in spite of application of an inhibitor and/or a complexing agent for silver ions no satisfying solution can be offered for the problems situated hereinbefore, addition of products providing (anionic) charges to the particles can be added in order to decrease the velocity of particle growth and flocculation as has e.g. been suggested in EP-A 0 223 883 and in U.S. Pat. Nos. 5,457,011 and 5,840,471 as well as in U.S. Pat. No. 5,824,458 wherein mercapto-alkyl carboxylic acids, mercapto-alkylamides or compounds, combining these two compounds have been proposed, thereby combining inhibition of dissolution and charging dissolved silver ions.

As is evident to anyone skilled-in-the-art of photography in the processing of materials coated with huge amounts of silver halide, problems will become more severe, as e.g. in the processing of radiographic materials used in diagnostic imaging, and still more in the processing of non-destructive film materials as has been set forth in EP-A's 0 620 483, 0 620 484 and 0 621 506.

Another form of sludge formation may occur in the developer and fixer solutions during processing as a consequence of the use of more ecologically interesting developing agents like ascorbic acid known from EP-A's 0 731 381, 0 731 382, 0 732 619 and Research Dislosure No. 371052, p. 185–224, published Mar. 1, 1995, especially when the silver halide materials are containing higher amounts of calcium, e.g. when using gelatin rich in calcium ions: oxidized ascorbic acid developer contains considerable amounts of oxalic acid, thereby forming calcium oxalate precipitate, as has been set forth in U.S. Pat. No. 5,723,267.

As already mentioned hereinbefore solving the problem of sludge formation set forth hereinbefore may lay burden on the desirable use of low replenishing amounts, set forth e.g. more specifically for ascorbic acid developers in EP-A 0 573 700 and in U.S. Pat. No. 5,503,965.

OBJECTS OF THE INVENTION

Therefore it is an object of the present invention to provide a photographic developer composition showing a reduced amount of sludge formation in order to eliminate the problems caused thereby like e.g. staining of the processed photographic material, in particular when low amounts of developer replenisher are used.

It is a further object of the present invention to postpone the formation of a precipitate in a photographic developer during processing of an exposed silver halide photographic material.

Another object of the present invention is to reduce the frequency of cleaning tanks containing developer solution in an automatic processor to at most twice a year.

It is still a further object of the present invention to prevent staining of the processed photographic film material, more particularly when said material is coated from high amounts of silver halide and/or silver halides having a higher solubility and/or when said material is loaded with high amounts of calcium compounds.

More in particular it is an object of the present invention to provide a developer having ascorbic acid as an ecologically interesting developing compound in order to process silver halide photographic film materials having low amounts of calcium compounds without stain or sludge formation, even when low replenishing amounts of developer are used.

Further on it is an object of the present invention to provide a method of processing materials having a low buffering capacity in dedicated developers preventing staining of the processed materials, even at low replenishing levels.

Further objects will become apparent from the description hereinafter.

SUMMARY OF THE INVENTION

The above mentioned objects are realized by providing a black-and-white silver halide developer composition, said composition comprising, besides one or more developing agent(s), agent(s) preventing oxidation thereof and agent(s) providing pH buffering, at least one silver complexing agent, characterized in that said silver complexing agent has a silver complexing stability ratio of at least 70%, wherein said silver complexing stability is determined after dissolving 50 mg of the said complexing agent in 200 ml of said developer composition, adding thereto under constant vigorous stirring 74 ml of a solution of silver nitrate having a concentration of 0.0005 moles/liter, adding over a period of 30 minutes said solution to the said developer solution thereby providing a total amount of added silver expressed as equivalent amount of silver nitrate of 15 mg/l, leaving said solution unstirred in order to provide an equilibrium state between formed precipitate and supernatant developer liquid and measuring the silver content in the said supernatant liquid after 3 weeks; wherein said complex stability ratio is calculated as ratio of silver content in supernatant liquid to total amount of silver added, and wherein said composition comprises, besides said silver complexing agent having a silver complexing stability ratio of at least 70%, at least one agent preventing silver dissolution, characterized in that said agent preventing silver dissolution makes silver content of the developer decrease in an amount of more than 50% versus in the absence thereof, without loss in speed in an amount of more than 0.10 log Exposure after processing in said developer composition.

DETAILED DESCRIPTION OF THE INVENTION

While the present invention will hereinafter be described in connection with preferred embodiments thereof, it will be understood that it is not intended to limit the invention to those embodiments.

In the following description the developer solution one of the solutions required in a processing cycle of black-and-white silver halide photographic materials (besides fixer solution, rinsing solution and, optionally, stabilizer solution) may be any of the solutions which is used in order to develop said black-and-white photographic material, i.a. a starting solution, a seasoned developer, a developing solution ready-for-use or the concentrated developer compositions thereof.

In order to avoid problems it is advised to make use of a developer starter solution: in order to minimize differences of performance of the photographic system minimizing differences in the composition between fresh and seasoned fixer solution is preferred, in that upon starting the process with a fresh developer, the developer solution chemistry in the processor is the replenishment developer solution chemistry, whether or not with a supplementary additive mixed therewith, said supplementary additive being the developer starter solution.

Said "fresh developer" is defined as the developer present in the developer unit of the processor before any film has passed, or in the alternative, the developer in which a very little amount of film was run, well before a steady state or equilibrium situation is reached (e.g. resulting in a "half-seasoned" developer in "running equilibrium conditions").

The "developer replenisher solution" is defined as the unused developer present in the developer container which is, in the method of the present invention, mixed in the developer unit with developer starter solution in order to prepare the "fresh developer" solution defined hereinbefore. It is clear that said "developer replenishing solution" is added further to the developer unit as the film is being processed, acting as a commonly used "replenisher" too.

The "seasoned developer" is defined as the developer present in the developer unit of the processor after processing enough film in order to reach a steady-state or an equilibrium situation, depending on the amounts of replenisher used. In order to reach said steady-state, the said developer is topped up with the "developer replenisher solution" defined hereinbefore.

As already mentioned hereinbefore the said developer solution comprises a mixture of a developer starter solution and developer replenisher solution, wherein it is understood that both solutions have been mixed before addition to the developer unit or tank of the automatic processor. In another embodiment an additional step is the step of adding of a developer starter solution to the developer replenisher solution which is present in the said developer unit or tank. In that case said developer starter solution is preferably added before starting processing, although it is not excluded to add the said developer starter solution during processing, i.e. after the processing has been started, before a "running equilibrium" or "seasoned" condition or state has been reached. In a preferred embodiment addition of the said starter developer solution proceeds before starting the processing cycle, i.e. when adding developer starter solution to developer replenisher solution the latter being present in a developer unit or tank of the processor. The case wherein developer starter solution is present in the developer tank before developer replenishing solution is added thereto and mixed therewith is however not excluded, so that more generally during processing the step of mixing of developer starter solution and fixer replenishing solution in a developer unit or tank of the said processor is possible. In a preferred embodiment however said developer starter solution is mixed with the developer replenishing solution in the processor before starting processing.

In one embodiment the developer starter solution is a buffering solution. Said buffering solution alters pH of the developer to the required value: so in a preferred embodiment said developer starter solution alters pH to a value in the range from −0.3 up to +0.3 units of the pH of the developer solution after seasoning. In another embodiment said developer starter solution is water or an alkaline solution. In still another embodiment an amount of developer starter solution is proportional to tank volume of the developer solution in the processor. In a further embodiment an amount of developer starter solution is less than 10% of volume of replenisher solution with which it is mixed upon starting processing.

Developer solutions may contain glutardialdehyde as hardening agent but in a preferred embodiment the developer is free thereof. It is clear that the light-sensitive black-and-white silver halide photographic materials processed in the developer composition according to the present invention should be hardened to such an extent that in a developing step free from hardening agents no problems occur as e.g. "sludge formation" in form of troubles due to lack of physical strength properties of the materials. A survey of hardening agents available in order to fore harden coated hydrophilic gelatinous layers of the said photographic materials has been given e.g. in Research Disclosure 38957, Chapter II.

As already set forth in the statement of the present invention a black-and-white silver halide developer composition has been disclosed comprising, besides one or more developing agent(s), agent(s) preventing oxidation thereof and agent(s) providing pH buffering, at least one silver complexing agent, characterized in that said silver complexing agent has a silver complexing stability ratio of at least 70%.

Generally speaking a silver complexing agent can be defined as an agent which has the ability to form water-soluble silver complexes, so that the silver complex thus formed is stable enough to withstand the reduction of the silver complex to metallic silver in the photographic developer.

The silver complexing ability of said silver complexing agent is measured by a method containing following steps:

1. dissolving 50 mg of the agent to be tested in 200 ml of developer (ready-for-use or seasoned);
2. adding, under constant vigorous stirring, 74 ml of a solution of silver nitrate having a concentration of 0.0005 moles/liter;
3. adding slowly said solution to the developer solution over a period of 30 minutes, providing a total silver amount of 15 mg/l;
4. leaving the solution unstirred and measuring the silver content in the supernatant fluid as a function of time: due to the reduction of the silver, a precipitation of sludge will occur, and the silver content in the supernatant fluid will decrease accordingly;
5. after 3 weeks having been left unstirred the silver in the supernatant fluid is determined analytically (AAS) and the complex stability ratio is determined: the said complex stability ratio is the ratio of the silver content in the supernatant fluid to the total amount originally added (15 mg/l). If e.g. after 3 weeks the silver content in the supernatant fluid is 7,5 mg/l then the complex stability ratio for that substance in that specific developer is 50%.

As defined in the statement of the present invention said silver complexing stability is thus determined after dissolving 50 mg of the said complexing agent in 200 ml of said developer composition, adding thereto under constant vigorous stirring 74 ml of a solution of silver nitrate having a concentration of 0.0005 moles/liter, adding over a period of 30 minutes said solution to the said developer solution thereby providing a total amount of added silver expressed as an equivalent amount of silver nitrate of 15 mg/l, leaving said solution unstirred in order to provide an equilibrium state between formed precipitate and supernatant developer liquid and measuring the silver content in the said supernatant liquid after 3 weeks; wherein said complex stability ratio is calculated as ratio of silver content in supernatant liquid to total amount of silver added.

A silver complexing agent as defined in the statement of the invention moreover makes, in a preferred embodiment, silver content of the developer in running equilibrium conditions increase in an amount of more than 1 mg per liter per mmole of said complexing agent.

According to the complex stability ratio obtained after 3 weeks the silver complexing ability of the substance in the corresponding developer is judged to belong to one of the following categories set forth in the Table 1 hereinafter.

TABLE 1

| Complexing ability category | Complex Stability ratio | |
|---|---|---|
| Category C1 | >90% | excellent complexing properties |
| Category C2 | >70% | good complexing properties |
| Category C3 | >50% | little complexing properties |
| Category C4 | <50% | no or insignificant complexing properties |

A substance which, in the conditions given above, has a complex stability ratio of more than 80% (thus belonging to the categories C1 or C2) as described in the experiment above is defined as a silver complexing substance suitable for use in the developer composition of the present invention.

The design of the experiment is critical. In order to get a suitable and predictable value of actual properties, it is important to add the silver nitrate slowly and as a highly diluted solution, in order to prevent immediate sludging during the addition of the silver solution. The experiment proposed gives results which are relevant for the actual behaviour of the substances under investigation.

In the developer composition according to the present invention said silver complexing agent is corresponding to the general formula (I)

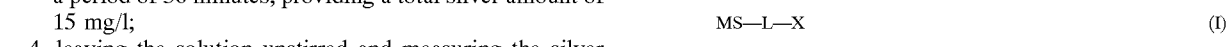

MS—L—X (I)

wherein

L is a divalent linking group;

M is selected from the group consisting of hydrogen, S—L—X, a group providing a thiolate anion under alkaline processing conditions and a charge compensating counterion for the said thiolate anion; and X is an acidic solubilizing group having a $pK_a$ of 7 or less or a salt thereof.

In a preferred embodiment in the developer composition according to the present invention in the general formula (I) MS— is linked to an aliphatic carbon atom.

In the most preferred embodiment MS— is linked to an aliphatic carbon atom and X is a sulphonic acid or a sulphonate salt.

Typical examples of complexing agents useful in the current invention are given below.

C-1

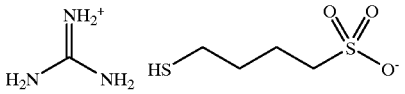

C-2

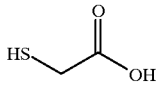

C-3

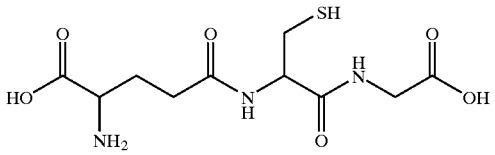

C-4

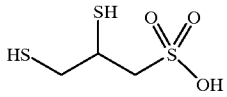

C-5

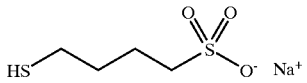

C-6

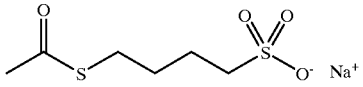

C-7

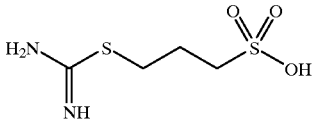

C-8

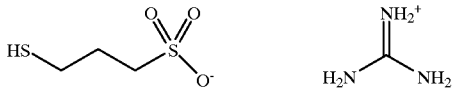

C-9

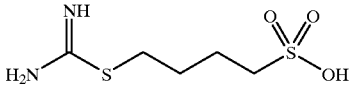

C-10

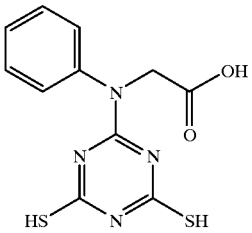

-continued

C-11

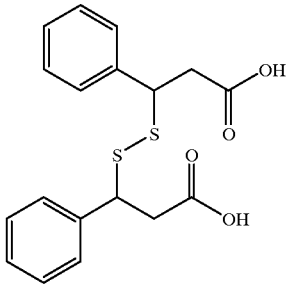

C-12

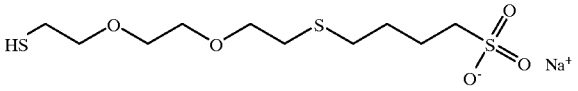

C-13

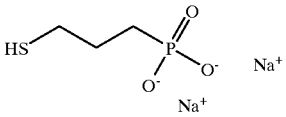

C-14

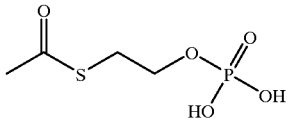

C-15

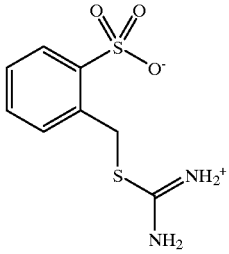

Otherwise the agent preventing silver dissolution or the silver elution inhibiting agent makes that upon processing of silver halide materials part of the silver halide crystals which is attacked by the photographic developer is not dissolved and eluted as such.

The amount of silver dissolved if no use is made from such agent preventing silver dissolution is highly dependent on the exposure of the material to be developed. Non-exposed materials clearly release substantially more silver into the photographic developer solution, and thus give raise to relatively more sludge. In exposed materials however there is a competition between development and dissolution of the silver halide crystals and as a result there will be less sludge. The total amount of sludge is thus highly dependent on the development conditions, on the composition of the film material and on the developer solution.

In order to characterize the "silver elution inhibiting properties" of a chemical compound or substance, called "inhibitor", in a specific photographic developer, following experiment is used: 30 mg of the inhibitor to be classified is dissolved in 150 ml of the said specific developer. The photographic developer is brought into a 'developing tank' and is kept at 35° C. Two times 3 m of an unexposed photographic material having a width of 48 mm is transported through the developer solution at a speed of 23 cm/min. The contact time between the developer solution and the film is 31 seconds. Samples of the developer solution are collected after 3 m has been running through the developer solution (1) and after 6 m of film has been transported through the developer solution (2). The silver content in the samples is determined immediately afterwards by AAS (atomic absorption spectrophotometry). The silver content after having transported 3 m and 6 m of film in the processing respectively is a measure for the "silver elution inhibition strength" of the inhibitor substance investigated for the particular combination of film and developer solution.

A similar (blank) experiment is performed in the absence of the chemical compound or substance under investigation. The inhibition strength is then defined by comparing the silver content with and without the substance under investigation in the developer solution. The "inhibition strength ratio" of a given "inhibitor" or "silver elution inhibiting compound" (for a typical combination of film material and developer) is defined as the ratio of the silver content in the developer solution containing the sludge inhibiting substance and the silver content in the developer solution without the said substance after processing 3 m of film in the above defined conditions. According to the inhibition strength ratio, the inhibitors are classified as represented in Table 2 hereinafter.

TABLE 2

| | Inhibition Strength Ratio (3m) | Appreciation |
|---|---|---|
| Category I1 | <30% | Very strong inhibition effect |
| Category I2 | <50% | Strong inhibition effect |
| Category I3 | >50% | Limited, absent or negative inhibition effect (promotion of elution of silver) |

A substance which, in the conditions as set forth, has an inhibition strength ratio of less than 50% in the experiment described above is defined as a silver dissolution inhibiting substance and thus corresponds to the Categories I1 or I2.

The developer composition of the present invention thus comprises, besides the silver complexing agent as defined before, at least one agent preventing silver dissolution characterized in that said agent preventing silver dissolution makes silver content of the developer decrease in an amount of more than 50% versus in the absence thereof (or otherwise said: has an inhibition strength ratio of less than 50%, wherein said "inhibition strength ratio" is defined as set forth above), without loss in speed in an amount of more than 0.10 log Exposure after processing in said developer composition, when the dissolution inhibitor is added in an amount in order to get a concentration of 50 mg/l.

In the developer composition according to the present invention said agent preventing silver salt dissolution preferably corresponds to the general formula (II)

(II)

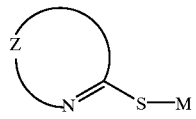

wherein Z represents atoms necessary to form a substituted or unsubstituted 5- or 6-membered hetero-aromatic ring, provided that the said hetero-aromatic ring is not substituted by a solubilizing group having a $pK_a$ of 7 or less, and M is selected from the group consisting of hydrogen, a group providing a thiolate anion under alkaline processing conditions and a charge compensating counterion for the said thiolate anion.

In a more preferred embodiment, the said hetero-aromatic ring is a 5-membered hetero-aromatic ring and in a still more preferred embodiment the said hetero-aromatic ring is selected from the group consisting of triazoles, thiadiazoles, imidazoles and benzimidazoles.

Typical examples of silver salt dissolution inhibitors are given below:

I-1

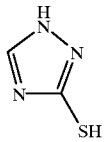

I-2

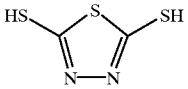

I-3

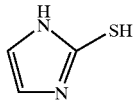

I-4

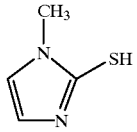

I-5

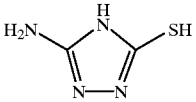

I-6

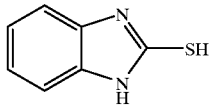

I-7

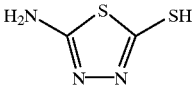

I-8

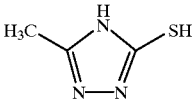

-continued

I-9

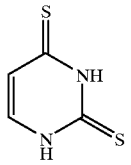

It is clear that a number of substances actually promotes the elution of silver ions out of the film material (negative inhibition effect). If these substances do not stabilize the eluted silver, they tend to promote the occurrence of sludge, and are therefore undesired. If these substances form a silver complex which is stable enough to stabilize the (increased) amount of eluted silver, this component may nevertheless be effective in preventing silver sludge formation.

As has been established above, silver elution inhibitors also tend to have a photographic influence. Therefore, the concentration of these inhibitors is important. When the concentration is too low, the anti-sludging action will be insufficient. When otherwise the concentration is too high, there will be significant sensitometric disadvantages. It has been found now that in practical circumstances the amount of inhibitor required for an optimum performance, i.a. to get a perfect balance between a desired sensitometry and anti-sludging properties, is not the one which would be expected on the basis of the sensitometric effect of the anti-sludging substances as assessed in laboratory experiments. Indeed in long-term regeneration (replenishment) experiments it has been found that an optimal performance in sludge can be achieved when the concentration of the inhibitor in the replenisher is appreciably higher than in the seasoned or in the fresh developer. It is assumed that this is due to the adsorption of the silver elution inhibitor on the image silver which causes depletion of the developer. As a consequence a clear effect on sensitometry is not observed and is smaller than expected and a higher concentration of the substance in the developer replenisher is allowed without having a dramatic influence on sensitometry as speed or gradation decreases.

Silver complexing agents tend to perform better in the silver complexing experiment described above when the concentration of the silver complexing substance is increased. From a practical point of view however an increase in the concentration of the silver complexing agent does not necessarily improve the performance with respect to sludge formation. Due to an increased amount of complexing agents in the developer, the amount of eluted silver will also increase. If the stability of the complex is insufficient or if the amount of complexing agent present is too low to stabilize the increased amount of silver, there is often a decrease in performance with respect to sludge in that sludge formation is not prevented as desired.

In the experiments related therewith in order to controll this statement no depletion of the silver complexing agent was found. From the said experiments it may be concluded that, opposite to the effects observed with respect to the silver elution inhibition agents as described above, complexing agents should not have a substantially increased concentration in the developer replenisher.

Many silver elution inhibiting substances exhibit a significant sensitometric effect. As a consequence these substances are not useful as sludge inhibitors in photographic developers: a silver elution or dissolution inhibiting agent present in a specific developer thereby causing a suitable effect with respect to the prevention of sludge formation and no sensitometric effect is called a suitable substance when in the experiment described above, it has an inhibition strength ratio of less than 50% and when it moreover causes a sensitometric loss in sensitivity (measured at a density of 1.0 above fog) of less than 0.10 log (Exposure), wherein said Exposure is the product I×t, representing Exposure Intensity and Exposure time, upon addition of 50 mg/l of the developer. In this case, the concentration of 50 mg/l refers to the concentration as added to the fresh developer or present in the seasoned developer and not to the concentration in the developer replenisher.

The combined action of inhibitor and complexant in the developer according to the present invention is explained as follows. The inhibitor minimizes the amount of silver ions dissolved or washed out from the film material. The complexing agent prevents the reduction of the eluted silver ions to silver and further to silver sludge formation. The inhibitors moreover are limiting the amount of silver ions washed out, and thereby also reduce the amount of complexing agents to be added in order to stabilize the silver ions in the used developer solution. The silver elution promoting properties of the complexing agents are thus limited by the use of a suitable inhibitor.

In a preferred embodiment according to the present invention the complexing substance in the developer composition is present in a concentration range between 10 and 2000 mg/l and, more preferably, in a concentration range between 25 and 500 mg/l.

In a further preferred embodiment the developer composition according to the present invention has, in running equilibrium conditions, a molar ratio of silver complexing agent to silver of more than 10:1.

In the developer composition according to the present invention said developing agents are selected from the group consisting of hydroquinone, 1-ascorbic acid, iso-ascorbic acid, reductic acid, 1-phenyl-3-pyrazolidine-1-ones (phenidones), salts and derivatives thereof. Said 1-ascorbic acid, iso-ascorbic acid, reductic acid are the more preferred forms from the ascorbic acid type developers according to the formula (III)

(III)

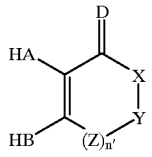

wherein in the formula (V) each of A, B and D independently represents an oxygen atom or $NR'^1$;

X represents an oxygen atom, a sulfur atom, $NR'^2$; $CR'^3R'^4$; C=O; $C{=}NR'^5$ or C=S;

Y represents an oxygen atom, a sulfur atom, $NR''^2$; $CR''^3R''^4$; C=O; $C{=}NR''^5$ or C=S;

Z represents an oxygen atom, a sulfur atom, $N'''^2$; $CR'''^3R'''^4$; C=O; $C{=}NR'''^5$ or C=S;

n' equals 0, 1 or 2;

each of $R'^1$ to $R'^5$, $R''^2$ to $R''^5$ and $R'''^2$ to $R'''^5$ independently represents hydrogen, alkyl, aralkyl, hydroxyalkyl, carboxyalkyl, alkenyl, alkynyl, cycloalkyl, cycloalkenyl, aryl or heterocyclyl; and wherein $R'^3$ and $R'^4$, $R''^3$ and $R''^4$, $R'''^3$ and $R'''^4$, may further form a ring together; and wherein in the case that $X=CR'^3R'^4$ and $Y=CR''^3CR''^4$, $R^3$ and $R'^3$ and/or $R^4$ and $R'^4$ may form a ring and in the case that $Y=CR''^3R''^4$ and $Z=CR'''^3CR'''^4$ with n=1 or 2, $R'^3$ and $R''^3$ and/or $R'^4$ and $R''^4$ may form a ring.

In a preferred embodiment in the formula (V) A, B and X each represent an oxygen atom; n'=0; Y=CH—$(CHOH)_{m'}$—$CH_2$—$R'^6$ wherein m'=1,2,3 or 4 and wherein $R'^6$ represents OH for m'=1; and H or OH for m'=2, 3 or 4. This formula corresponds with (iso)ascorbic acid.

As a suitable derivative corresponding to the formula (V), isoascorbic acid and 1-ascorbic acid are both preferred. In another preferred embodiment A and B each represent an oxygen atom; n'=O and X and Y each correspond with $C(CH_3)_2$. This formula corresponds with tetramethyl reductic acid.

The compound(s) according to the formula (V) preferably is (are) present in the developer solution in an amount comprised between 1 g and 100 g per liter, although a preferred amount of from 20 up to 50 g per liter is sufficient in many cases.

Examples of reducing precursor compounds have, e.g., been described in WO's 94/3834 and 94/16362.

It is clear that within the context of the present invention ascorbic acid is not merely used in the developer as an antioxidant as e.g. described in WO 93/12463, in JP-A's 4428673 and 55149936, in GB 1,266,533 and in U.S. Pat. Nos. 3,865,591; 4,756,997 and 4,839,259 and in the literature as, e.g., J. Am. Chem. Soc., 60 (1938), p. 99 and p. 2084; 61 (1939), p. 442; 64 (1942), p. 1561, 65 (1943), p. 1489; 66 (1944), p. 700 and 104 (1982), p. 6273. According to the method of the present invention said antioxidant or agent preventing oxidation is selected from the group consisting of a sulfite salt, 1-ascorbic acid, iso-ascorbic acid, reductic acid, salts and derivatives and combinations thereof. A combination of high amounts of ascorbic acid type compounds and low amounts of sulfite is therefore highly preferred as the presence of sulfite normally leads to undesirable odours in the processing. Low amounts of sulfite as e.g. disclosed in EP-A 0 738 400 are therefore preferred: amounts of less than 0.4 mole per liter of developer are satisfactory in order to prevent oxidation by air oxygen. According to the present invention the photographic developer solution thus comprises as an agent preventing oxidation sulfite present in a free sulfite concentration below 0.4 M.

According to the present invention besides ascorbic acid, reductic acid, stereoisomers or derivatives thereof as developing agents the developer comprises, as auxiliary developing compounds, one or more 1-phenyl-3-pyrazolidine-1-one or 1-phenyl-5-pyrazolidine-1-one, commonly known as "phenidone" compound. A preferred phenidone compound used in the method of the present invention is 4,4'-hydroxymethyl-methyl-1-phenyl-3-pyrazolidine-1-one, which is present in amounts of from 0.5 g up to g/liter of developer. Especially if iodide ions are present in the developer solution, said preferred phenidone compound is present in lower amounts as has been disclosed in U.S. Pat. No. 5,296,342.

In a preferred embodiment according to the present invention said developer composition is substantially free from any polyhydroxybenzene compound, as e.g. hydroquinone, analogues and/or derivatives therefrom.

According to the present invention the developer contains pH buffering agent(s), wherein said agents are selected from the group consisting of carbonates, phosphates and borates and combinations thereof. More particularly carbonate buffers applied may be those described in EP-A's 0 565 459 and 0 736 802 (together with borate) and in U.S. Pat. Nos. 5,648,205 and 5,738,979; whereas borate buffers may be those as described in GB-A 2,292,813 and in U.S. Pat. Nos. 5,702,875; 5,756,271 and 5,853,964 and phosphate buffers as in U.S. Pat. Nos. 5,585,610; 5,744,279; 5,858,612 and 5,876,907. It is well known that the amount of alkali necessary during development is largely dependent on two factors, namely the amount of silver to be developed (g/m2) and the amount of acid released during the development reaction (mmoles of hydrogen ions released per mole of developed silver). As has been extensively disclosed in EP-Application No. 98201862, filed Jun. 5, 1998 it has been found that, apart from these factors, which were known before, there is another important contribution, in particular in the case of ascorbic acid developers used at low regeneration rates, and that the main factor which causes these differences is the buffer capacity of the film materials as defined therein. In order to provide a stable or constant sensitometry by making use of a developer according to the present invention processing is performed at low replenishment rates (as e.g. lower than 200 ml per sq.m., more preferably 150 ml per sq.m. and even lower than 100 ml per sq.m. as described in EP-A 0 874 276). It is further recommended, as described in EP-Application No. 98201862, filed Jun. 5, 1998, in particular for photographic materials having silver halide, coated in an amount, expressed as an equivalent amount of silver nitrate of less than 6 g/$m^2$ that the said material has a buffering capacity of less than 6 mmole/$m^2$, preferably of less than 4 mmole/$m^2$ and even more preferably less than 2.5 mmole/$m^2$, wherein said buffering capacity is defined as the amount of alkali, expressed in mmole/square meter required to bridge across pH differences between the material and the developer. In a preferred embodiment the processing making use of a developer composition according to the present invention proceeds in a total dry-to-dry processing time of less than 100 seconds. It is however clear that making use of the developer of the present invention is not restricted to the processing of materials coated with such low amounts of silver halide and that also silver halide materials rich in coated amounts of silver, as e.g. double-side coated materials for non-destructive testing purposes having an amount of silver up to 20 g per sq.m. and per side of the support, said amount of silver being expressed as an equivalent amount of silver nitrate, which have been disclosed e.g. in EP-A 0 698 817. In a preferred embodiment according to the present invention the developer composition is buffered between a value of from 9.0 up to 11.0 by buffering compounds having a concentration of from 0.3 up to 1.0 mole/liter and more preferably from 0.3 up to 0.7 mole/liter. Particularly suitable buffering compounds in the developer composition are carbonates as has also been shown in EP-A 0 565 459, wherein the use of ascorbic acid developers with high concentrations of carbonate buffering is illustrated. The high carbonate level provides a high degree of pH buffering and also provides aeration protection via reduced oxygen solubility in the developer solution. Use of highly buffered ascorbic acid developers as has been disclosed e.g. in U.S. Pat. No. 5,503,965, wherein the instability of ascorbic acid developers has been tackled not only by the use of highly buffering solutions but in addition by the use of replenisher solutions having a higher pH, already suggested hereinbefore, is further recommended. The use of developers having a higher buffer capacity however increases the likelihood of aluminum sludging in the fixer, since the pH increase in the fixer solution due to carry-over of alkaline developer will be greater. Therefore in a preferred embodiment a compound having an α-ketocarboxylic acid structure (as oxalic acid, tartaric acid, citric acid, gluconic acid or derivatives thereof) in an amount of not more than 3 g per liter is present in the said fixer solution while starting processing or in the said fixer replenisher.

In order to compensate during processing for a decrease of pH due to the oxidation of ascorbic acid type developing agents to oxalic acid it is recommended to provide pH of the developer replenisher to be higher as e.g. in EP-A 0 573 700 and in U.S. Pat. No. 5, 869,218 and more particularly about 0.5 higher than the developer itself as in U.S. Pat. No. 5,503,965; although depending on the composition of the developer pH differences of 0.1 to 0.3 pH units may be sufficient as disclosed in U.S. Pat. No. 5,738,979. In the alternative mixtures of two pyrazolidones may compensate for pH drop as has been suggested in EP-A 0 588 408. Ascorbic-acid type developers used in the method of the present invention preferably have a pH in the range from 9–11, but lower values as e.g. in U.S. Pat. Nos. 5,702,875; 5,756,271; 5,853,964 and 5,858,610 are not excluded. Alkalizing agents providing the desired pH are e.g. those described in U.S. Pat. No. 5,821,041. According with the present invention the developer solution has a regeneration rate of less than 150 ml/m2 while the pH of the developer solution in running equilibrium conditions is between 9.5 and 9.9, with a pH difference between the seasoned developer and the developer replenisher between 0.3 and 0.6.

A method of processing a black-and-white silver halide photographic material has thus, according to the present invention, also been provided wherein said method comprises the steps of developing, fixing, rinsing and drying, and wherein in running equilibrium conditions a developer composition according to the present invention as disclosed hereinbefore is used in the developing step. In a preferred embodiment said developer composition is replenished with same developer composition in an amount of less than 200 ml/m2, and even more preferably in an amount of less than 150 ml/m2. In an even more preferred embodiment use is made in the developing step of an ascorbic acid type developer and an equivalent developer replenisher providing a regeneration amount of less than 200 ml/m$^2$, and more preferably less than 150 ml/m$^2$.

From the detailed description hereinbefore it is clear that the present invention clearly provides a developer for use in the of processing black-and-white light-sensitive silver halide photographic materials, although the target is more severe for the processing with less sludge formation when having in the light-sensitive layer(s) of the said materials photosensitive emulsions rich in silver chloride, wherein said developer is preferably an ascorbic acid type developer used in a processing which is performed at low replenishment rates (less than 150 ml/m$^2$) in order to get a stable or constant sensitometry, even over long working periods with low total amounts of materials to be developed, with moreover the specific feature that the said material having low coating amounts of silver halide has a buffering capacity of less than 6 mmole/m$^2$.

Thereby problems are thus encountered with respect to the constancy of the pH of the ascorbic acid type developer, use of L amounts of buffering agents in huge amounts and combination of differing buffer solutions, use of developer replenishers having a higher pH than the pH of the developer and all measures taken in order to decrease deactivation of the developer composition when no material is processed. Especially when the silver halide materials are containing higher amounts of calcium, e.g. when using gelatin rich in calcium ions: oxidized ascorbic acid developer contains considerable amounts of oxalic acid, thereby forming calcium oxalate precipitate, as has been set forth in U.S. Pat. No. 5,723,267. A factor which is important, particularly when making use of ascorbic or reductic acid type developing agents as in a preferred embodiment of the developer according to the present invention, is the calcium content of gelatin used as a colloidal binder in emulsion preparation and/or coating. In most commercial high-quality inert gelatins the calcium content is about 0.4%, which corresponds with about 100 mmole/kg, measured at the end of the preparation process of inert gelatin. Complex-bound calcium ions strongly decrease the electric potential carried by gelatin. Substantially "calcium free gelatin" is thus defined as gelatin with a calcium content at a level below 40 ppm which corresponds with the analytical detection limit. Use thereof is therefore highly preferred in the context of the present invention in order to avoid sludging as a consequence of formation of calcium oxalate precipitate due to generation of oxalic acid as oxidized developing agent in the processing of such materials. Therefore in the context of the present invention recommended amounts of calcium present in materials processed when making use of a developer composition according to the present invention are less than 10 mg/sq.m. as in U.S. Pat. No. 5,723,267, more preferably of less than 5 mg/sq.m. and still more preferably of less than 3 mg/sq.m.

Materials suitable to be processed in a processing cycle, making use of a developer composition according to the present invention are light-sensitive black-and-white silver halide photographic material being single-side or double-side coated materials, coated on a subbed support with one or more light-sensitive silver halide emulsion layers, wherein said halide is selected from the group consisting of chloride, bromide and iodide and mixtures thereof and said emulsion comprises crystals having a habit selected from the group consisting of a {100} tabular, a {111} tabular and a cubic habit and mixtures thereof as in BE 93001438, in EP-A's 0 288 949, 0 528 480, 0 555 897, 0 573 373, 0 574 331, 0 592 616, 0 614 111, 0 622 668, 0 581 065, 0 678 772, 0 704 750, 0 709 730, 0 724 193, 0 731 382, 0 736 797, 0 786 694, 0 770 909, 0 809 135, 0 809 139, 0 843 207, 0 851 282, 0 862 083, 0 862 088, 0 866 362, 0 890 873, 0 908 764, 0 911 687 and 0 911 688; in EP-Application No. 98200061, filed Jan. 13, 1998, No. 98200236, filed Jan. 27, 1998; No. 98200281, filed Jan. 30, 1998, No. 98200901, filed Mar. 23, 1998, No. 98201093, filed Apr. 7, 1998, No. 98201862, filed Jun. 5, 1998 and No. 99200295, filed Feb. 2, 1999 and in U.S. Pat. Nos. 4,400,463; 4,434,226; 4,783,398; 5,035,992; 5,061,609; 5,292,631; 5,230,994; 5,298,372; 5,378,600; 5,420,001; 5,561,038; 5,565,315, 5,607,828; 5,612,176; 5,614,359; 5,629,142; 5,641,620; 5,633,126; 5,677,119; 5,691,128; 5,693,459; 5,707,792; 5,707,793; 5,707,794; 5,712,081; 5,716,769; 5,733,715; 5,756,277; 5,759,759; 5,733,516; 5,733,718; 5,780,209; 5,780,217; 5,800,976; 5,853,972; 5,856,075; 5,871,890; 5,876,913 as well as in WO 93005442.

The said light-sensitive silver halide emulsions mentioned hereinbefore, present individually or as a mixture of different emulsions, can be present in one or more adjacent layers at one side or at both sides of a support material and grains or crystals present therein may be cubic grains (whether or not with rounded corners as a consequence e.g. of use of grain growth modifiers, such as e.g. methionin, during crystal preparation) more rich in silver chloride or more rich in silver bromide with, preferably, in favour of developablity, at most 3 mole % of iodide and more preferably even less than 1 mole % up to 0.1–0.01 mole % and even grains free from iodide, wherein the crystal diameter of said cubic grains is normally between 0.10 and 2.0 $\mu$m, more preferably between 0.15 and 1.5 $\mu$m and still more preferably between 0.15 and 1.0 $\mu$m, depending on sensitometric requirements (especially sensitivity).

In another embodiment the said light-sensitive silver halide emulsions present individually or as a mixture of different emulsions may be present in one or more adjacent layers at one side or at both sides of the support material and grains or crystals present therein and may be {111} or {100} tabular grains rich in silver bromide (more than 50 mole % of bromide) or rich in silver chloride (more than 50 mole % of chloride). Said tabular grains preferably account for at least 50% of the total projective surface area of all grains, more preferred for at least 70% and still more preferred for at least 90 %, further normally have an average crystal diameter (equivalent circular diameter leading to an equal total flat surface as the preferred hexagonal {111} or rectangular {100} grain) of from 0.3 to 3.0 μm, more preferably from 0.5 to 2.5 μm and still more preferably from 0.5 to 1.5 μm, for an average thickness of the tabular grain from 0.05 up to 0.30 μm, more preferably from 0.05 to 0.25 μm and still more preferably from 0.06 to 0.20 μm. Average aspect ratios of the {111} or {100} tabular grains obtained after calculation from the ratio of diameter to thickness measured for each grain are in the range 2:1 to 100:1, more preferably from 5:1 to 50:1 and still more preferably from 5:1 to 20:1 or even from 8:1 to 20:1. Variation coefficients calculated over grain diameters or thicknesses are normally less than 0.40, more preferably less than 0.30 and even more preferably in the range from 0.10–0.20, thereby being indicative for the degree of homogeneity of the grain distribution in an emulsion.

It should be established that in order to stabilize the thermodynamically unstable {111} habit of corresponding tabular grains it is recommended to add a crystal habit modifier (being a habit stabilizer) in the preparation step (especially in the growth step of the flat parallel twin planes). This is more preferred for {111} grains rich in silver chloride than for grains rich in silver bromide as, due to large differences in solubility of both silver halides (factor 100) the more soluble silver chloride tends to crystallize in a preferred cubic habit. Preferred crystal habit modifiers which are useful in the preparation of {111} tabular grains for use in the method of the present invention have e.g. been described in U.S. Pat. Nos. 5,176,991; 5,178,997; 5,185,239; 5,217,858; 5,221,602; 5,252,452; 5,272,052; 5,286,621, 5,298,385; 5,298,387; 5,298,388; 5,399,478; 5,411,851; 5,411,852; 5,418,127; 5,601,969; 5,691,128 and 5,756,277. When phases differing in silver halide composition are present over the crystal volume said crystal is said to have a core-shell structure. More than one shell can be present and between different phases it may be recommended to have a phase enriched in silver iodide by applying the so-called conversion technique during preparation. Iodide ions can be provided by using aqueous solutions of inorganic salts thereof as e.g. potassium iodide, sodium iodide or ammonium iodide. Iodide ions can also be provided by organic compounds releasing iodide ions as has e.g. been described in EP-A's 0 561 415, 0 563 701, 0 563 708, 0 649 052 and 0 651 284 and in WO 96/13759. Especially in order to obtain a more homogeneous iodide distribution in the crystal lattice and over the whole crystal population iodide ions provided by organic agents releasing iodide ions are preferred such as mono iodide acetic acid, mono iodide propionic acid, mono iodide ethanol and even hydrogels containing iodide ions, capable to generate iodide ions. Another way to provide the same result has been described in U.S. Pat. Nos. 5,248,587; 5,318,887 and 5,420,007 wherein use has been made of very fine silver iodide emulsion crystals having an average diameter of about 0.050 μm or even less (so-called Lippmann emulsions). Although preferred with respect to intrinsic and to spectral sensitivity it is recommended to limit average iodide concentrations to up to 1 mole %, more preferably to 0.5 mole %, and still more preferably from 0.1 to 0.3 mole % based on the total silver amount as higher concentrations retard development and lead to unsatisfactory sensitivities. Moreover the velocity of fixation can be disturbed in that case and as a consequence residual colouration may be unavoidable.

All cited references above are related with the preparation of emulsions having a crystal habit and halide composition as set forth hereinbefore, and in more particular references with the use of dedicated protective colloids in the precipitation thereof (as specific gelatins and/or derivatives, colloidal silica, oxidized cationic starch, etc.), dopants incorporated in the crystal lattice of the silver halide, built-up of halide in the crystal volume (homogeneous or heterogeneous as in core-shell emulsions), measures to provide more homogenous crystal size distributions of silver halide crystals in silver halide emulsions (with respect to average crystal diameter and/or thickness—where applied ), chemical ripening thereof (with ripening agents providing chalcogen—sulphur, selenium, tellurium—sensitization, noble metal—gold, palladium—sensitization, reduction sensitization, whether or not in combination with each other, spectral sensitization before, simultaneous with or after said chemical sensitization, addition before coating of solutions containing stabilizers, development accelerators—which may also be added to the developer solution in the processing—non-spectrally sensitizing dyes providing image definition or dye precursors providing shift in image tone or dye formation, coating aids, plasticizers, antistatic agents, matting agents, sequestering agents, image tone modifiers, agents enhancing covering power, and even anti-sluding agents—silver complexing agents and silver dissolution inhibiting agents—as disclosed in the developer composition of the present invention, said anti-sludging agents being present in lower amounts than set forth hereinbefore in the processing of coated materials. All these topics have also been extensively disclosed in Research Disclosures, further called "RD", No. 340, p. 612–615 (1992); No. 375, p. 491–495 (1995); No. 377, p. 607–608 (1995), No. 381, p. 45–59(1996), No. 388, p. 509–512 (1996), No. 389, p. 591–639 (1996), No. 391, p. 713–723 (1996), No. 394, p. 100–107 (1997), No. 394, p. 120–129 (1997), No. 394, p. 83–89 (1997), No. 401, p. 583–594 (1997), No. 404, p. 867–868 (1997), and No. 412, p. 1058 (1998).

More particular black-and-white silver halide photographic materials suitable to be processed in developer compositions according to the present invention are radiographic materials (as e.g. double-side coated materials for chest imaging—see U.S. Pat. Nos. 5,595,864; 5,693,370 and 5,811,229; and EP-A's 0 678 772 and 0 770 909—or single-side coated materials for mammography as disclosed e.g. in EP-A 0 874 275 and in U.S. Pat. No. 5,449,599), laser recording materials (as e.g. hardcopy materials as described in EP-A 0 610 608 and in U.S. Pat. No. 5,712,081) and micrographic materials. (as e.g. those described in U.S. Pat. No. 5,523,197 and in EP-A's 0 634 691, 0 634 692 and 0 634 693).

Having described in detail preferred embodiments of the current invention, it will now be apparent to those skilled in the art that numerous modifications can be made therein without departing from the scope of the invention as defined in the appending claims and in following examples.

EXAMPLES

Example 1

In order to determine the complexing properties of compounds having ability to form silver complexes as defined in the statement of the present invention following experiment was performed, wherein as a useful substance the compound according to the formula (C-2) was examined.

(C-2)

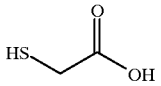

The silver complexing ability was measured as follows:

1. From compound CC-2 50 mg was added to 200 ml of the test developer the composition of which is given hereinafter in Table 3.
2. Under constant vigorous stirring making use therefore from a magnetic stirrer, 74 ml of a 0.0005 mole/l of a silver nitrate solution was slowly added to the developer solution over a period of 30 minutes, giving a total silver amount of 15 mg/l.
3. After addition of this silver nitrate solution, the solution was left unstirred and the silver content in the supernatant fluid was measured (by the atomic absorption spectrophotometric technique, also called "AAS") as a function of time.

TABLE 3

| Composition of the test developer | |
|---|---|
| Components of developer | Amount |
| Demineralized water | 400 ml |
| Potassium metabisulfite | 23 g |
| Hydroxyethyldiphosphonic Acid (60%) | 0.9 ml |
| Trilon B | 4 ml |
| Sodium erythorbate.aq | 61.5 g |
| Potassium bromide | 1 g |
| Potassium thiocyanate | 1 g |
| Polyglycol 400 | 20 ml |
| 2-Methyl-benztriazole | 30 mg |
| 4,4'-hydroxymethyl-methyl-1-phenyl-3-pyrazolidine-1-one | 2 g |
| Potassium carbonate | 125 ml |
| Demineralized water | 400 ml |
| Acetic acid | 11.5 ml |
| Demineralized water up to | 1000 ml |

Density of the test developer: 1.217; pH = 9.65.

Following Table 4 lists the measured silver levels in the supernatant fluid and compares the results with a similar experiment, where no complexant was added to the developer.

TABLE 4

| | Silver concentration AAS (mg/l) | |
|---|---|---|
| Time | 0 mg/l of compound CC-2 | 250 mg/l of compound CC-2 |
| 1 week | <1.0 | 17.1 |
| 3 weeks | <1.0 | 14.0 |
| 6 weeks | <1.0 | 3.4 |
| 9 weeks | <1.0 | <1.0 |

As is clear from the results in Table 4 the complexing agent has a strong influence on the level of silver precipitation. Complexing agent C-2 stabilizes the silver ions present in the developer for a period of approximately 3 weeks. After 3 weeks silver starts to precipitate and starts to cause sludge formation.

In the developer without complexing agent silver is already precipitated after 1 day (visual observation). After 1 week all silver has been precipitated.

Obviously a strong difference exists in the time after which a silver precipitate is formed in the absence or in the presence of a useful complexing agent for silver ions as the one according to the formula C-2 hereinbefore.

Example 2

Complexing agents suitable for use in the developer composition according to the present invention have been tested, according to the procedure described above. The results are listed in Table 5 hereinafter.

TABLE 5

| Product | amount (mg/200 ml) | Silver concentration (mg/l) in supernatant liquid (after 3 weeks) | Complex stability ratio (in %) |
|---|---|---|---|
| C-1 | 50 | 15.0 | 100 |
| C-2 | 50 | 14.0 | 93 |
| C-9 | 50 | 15.0 | 100 |
| C-4 | 50 | 14.0 | 93 |
| C-5 | 50 | 15.0 | 100 |
| C-6 | 50 | 15.0 | 100 |
| C-7 | 50 | 14.5 | 97 |
| C-8 | 50 | 15.0 | 100 |
| C-10 | 50 | 10.5 | 70 |
| C-11 | 50 | 10.5 | 70 |
| — | — | 0.5 | 3 |
| comp. 1 | | 0.9 | 6 |
| comp. 2 | | 0.5 | 3 |

comp. 1

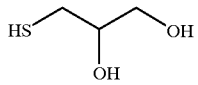

comp. 2

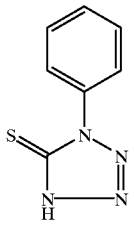

Comparative examples without solubilizing group the formulae or which have been represented above do not show a significant improvement with respect to the "complex stability ratio" if compared with a reference sample without complexing agents (----). Introduction of suitable stabilizing groups clearly improves the stability of silver ions present in the developer.

Example 3

An experiment similar to the experiment in Example 1 was performed. In this case however amounts of silver and complexing agent were varied. The silver concentration in the silver nitrate solution was varied from 0.0005 mole/l up to 0.0040 mole/l, resulting in a total amount of silver added from 15 to 120 mg/l. The concentration of complexing agents was varying from 0 to 2000 mg/liter. As preferred complexing agent use was always made from compound C-1.

C-1

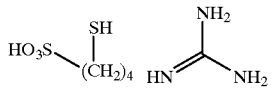

The Table lists the concentration of the silver nitrate solution, the total amount of silver added (in mg/l), the amount of complexing agent C-1 added (in mg/l) and the molar ratio of complexing agent to silver. In the said Table 6 also the amount of silver measured in the supernatant fluid after 3 weeks and the relative procentual amount of silver in the solution after 3 weeks has been summarized. When the relative amount is close to 0, all silver has been precipitated. When the relative amount is close to 100%, this means that all silver ions are still in solution (only a limited amount or even no precipitation has taken place). As appears from the Table 6, the molar ratio of complexing agent to silver must be larger than a factor of 5 (for the time of 3 weeks as set forth hereinbefore). The smaller the ratio, the less stable is the solution. If the ratio of complexing agent to silver is higher than 10, the stability is much better.

TABLE 6

| [AgNO3] (molar) | [Ag] St (molar) | CC-1 (molar) | CC-1/Ag | [Ag] (3 weeks) | % rest (3 weeks) |
|---|---|---|---|---|---|
| 0.0005 | 0.14 | 0 | 0.0 | 0.5 | 3 |
| 0.0020 | 0.56 | 0 | 0.0 | 0.5 | 1 |
| 0.0040 | 1.11 | 0 | 0.0 | 0.5 | 0 |
| 0.0005 | 0.14 | 0.51 | 3.6 | 8.8 | 59 |
| 0.0010 | 0.28 | 0.51 | 1.8 | 0.6 | 2 |
| 0.0020 | 0.56 | 0.51 | 0.91 | 0.5 | 1 |
| 0.0005 | 0.14 | 1.27 | 8.5 | 15.2 | 101 |
| 0.0020 | 0.56 | 1.27 | 2.3 | 8.5 | 14 |
| 0.0005 | 0.14 | 3.30 | 23.6 | 15.2 | 101 |
| 0.0010 | 0.28 | 3.30 | 11.8 | 30.2 | 101 |
| 0.0020 | 0.56 | 3.30 | 5.9 | 51.4 | 86 |
| 0.0040 | 1.11 | 3.30 | 3.0 | 8.3 | 7 |
| 0.0020 | 0.56 | 5.1 | 9.1 | 61.1 | 102 |
| 0.0040 | 1.11 | 5.1 | 4.6 | 123.1 | 103 |
| 0.0020 | 0.56 | 6.6 | 11.8 | 59.0 | 98 |
| 0.0040 | 1.11 | 6.6 | 6.0 | 112.5 | 94 |
| 0.0040 | 1.11 | 10.2 | 9.2 | 122.9 | 102 |

As is clear from the Table the molar ratio of complexing agent to silver should preferably exceed a value of 5:1. The lower this value the less stable the solution with the silver complexing agent.

Example 4

A tabular {111} silver chloroiodide emulsion was prepared as follows, starting from the solutions given hereinafter:

- 3 l of a dispersion medium (C) containing 0.444 moles of sodium chloride, 15 g of inert gelatin and 270 mg of adenine; temperature was established at 45° C. and pH was adjusted to 5.5;
- a 2.94 molar silver nitrate solution (A);
- a solution containing 4.476 moles of sodium chloride and 420 mg of adenin (B1).

A nucleation step was performed by introducing solution A and solution Bi simultaneously in dispersion medium C both at a flow rate of 30 ml/min during 30 seconds. After a physical ripening time of 15 min during which the temperature was raised to 70° C. and 97.5 g of gelatin and 1500 ml of water were added and the mixture was stirred for an additional 5 minutes. Then a growth step was performed by introducing by a double jet during 66 minutes solution A starting at a flow rate of 7.5 ml/min and linearly increasing the flow rate to an end value of 37.5 ml/min, and solution B1 at an increasing flow rate as to maintain a constant mV-value, measured by a silver electrode versus a saturated calomel electrode (S.C.E.), of +92 mV. In order to get an average iodide content in the {111} tabular silver chloroiodide crystals of 1.3 mole % a further amount of 0.8 mole % of iodide was added at the end of the preparation stage by addition of a KI-solution. A {111} tabular silver chloroiodide emulsion was thus obtained the average equivalent circular crystal diameter of which was 1.25 μm and the average thickness of which was 0.17 μm.

To this dispersion medium an amount of 1.25 mmole per mole of silver chloride was added of the dye anhydro-5,5'-dichloro-3,3'-bis(n-sulphobutyl)-9-ethyloxacarbocyanine hydroxide. After cooling to about 40° C. the pH value of the said dispersing medium was adjusted to a value of 3.0 with sulphuric acid, and after the addition of 55.5 ml of polystyrene sulphonic acid the obtained flocculate was decanted and washed three times with an amount of 6 l of demineralized water in order to remove the soluble salts present.

Chemical ripening agents were gold thiocyanate, sodium thiosulphate as a source of sulphur and toluene thiosulphonic acid was used as predigestion agent. The amounts of each chemical ripening were optimized in order to obtain an optimal fog-sensitivity relationship after 2 hours at 57° C.

Before coating each emulsion was stabilized with 1-p-carboxy-phenyl-5-mercaptotetrazole and after addition of the normal coating additives the solutions were coated simultaneously together with a protective layer containing 1.3 g gelatine per $m^2$ per side on both sides of a polyethylene terephthalate film support having a thickness of 175 μm.

The resulting photographic material contained per side an amount of silver halide corresponding to 4.5 grams of $AgNO_3$ per $m^2$ and an amount of gelatin corresponding to 3.55 g/$m^2$.

Samples of these coatings had been exposed with green light of 540 nm during 0.1 seconds using a continuous wedge and had been processed during the 98 seconds cycle described hereinbefore.

The density as a function of the light dose was measured and therefrom were determined the following parameters:

- fog level F (with an accuracy of 0.001 density),
- the relative speed S at a density of 1 above fog (an increase of the said speed with a factor of 2 gives a speed value that is 0.30 lower as the relation is logarithmic and as less light is needed to get the desired density),
- the contrast expressed as gradation G, calculated between the densities 0.25 and 2.0 above fog,
- the maximum density DMAX.

The processing was run in the the test developer the composition of which has been given hereinbefore in Table 3. To the developer, different amounts of complexing agents were added and developing was followed by fixing in the hardener free test fixer the composition of which has been given hereinafter in Table 7, further followed by rinsing. The whole processing cycle was run in a Curix HTU 330 processing machine, marketed by Agfa-Gevaert N.V. The total processing cycle was run in 60 s at 35° C. as developing temperature.

TABLE 7

| Test Fixer | |
|---|---|
| Ammonium thiosulphate (60% solution, wherein 1 ml comprises 0.778 g) | 710 ml |

TABLE 7-continued

| Test Fixer | |
|---|---|
| Sodium metabisulphite | 80 g |
| Sodium acetate | 130 g |
| Acetic acid | 31 ml |
| pH ready-for-use (after dilution 1 + 3) | 4.90 |

From the sensitometric data given in the Table 8 hereinafter it can be cocluded that, in general, there is only a limited influence of the complexing agent on sensitometry, even for relatively high concentrations of complexing agents the formulae of which have been given hereinbefore.

TABLE 8

| Complexing agent | Amount mg/l | F | S | G |
|---|---|---|---|---|
| C-11 | 0 | 0.226 | 1.67 | 3.59 |
| | 50 | 0.225 | 1.70 | 3.55 |
| | 200 | 0.224 | 1.72 | 3.34 |
| | 1000 | 0.220 | 1.75 | 2.98 |
| C-3 | 0 | 0.219 | 1.70 | 3.58 |
| | 50 | 0.222 | 1.68 | 3.59 |
| | 200 | 0.221 | 1.70 | 3.51 |
| | 1000 | 0.252 | 1.76 | 3.02 |
| C-1 | 0 | 0.224 | 1.70 | 3.56 |
| | 50 | 0.225 | 1.69 | 3.56 |
| | 200 | 0.226 | 1.69 | 3.47 |
| | 1000 | 0.228 | 1.74 | 3.00 |

Example 5

In following experiment it was a goal to determine the silver elution properties of a substance added to a specific photographic developer solution, namely for component I-1.

30 mg of said compound was dissolved in 150 ml of developer. The photographic developer was brought into a 'developing tank' and was kept at 35° C. 2 lengths of 3 m of unexposed photographic material strips having a width of 48 mm were transported through the developer solution at a speed of 23 cm/min. The contact time between the developer solution and the film is 31 seconds. Samples of the developer solution were taken after 3 m and 6 m of film strip were transported.

The silver content in the samples was determined immediately afterwards by AAS. The silver content after 3 and 6 meters of film processing has been shown in the next Table 9.

A similar experiment was performed in the absence of the substance under investigation. The inhibition strength was defined by comparing the silver content with and without the substance under investigation.

TABLE 9

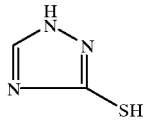

I-1

| Film | Silver content (mg/l determined by AAS) Reference | 200 mg of compound I-1/l |
|---|---|---|
| 3 m | 12.5 | 2.9 |
| 6 m | 30.2 | 9.8 |

In the present Example 5, an inhibition strength ratio of 2.9/12.5=23% as defined in the detailed description hereinbefore was calculated.

As is clear from this experiment the inhibition strength ratio, which is preferably as low as possible, is about 23%, which means that inhibition by the compound according to the formula I-1 is about 4 times stonger than the inhibition in its absence (without inhibiting compound I-1 the inhibition strength ratio is 100%).

Example 6

A number of compounds classified as inhibitors was tested with respect to their inhibiting properties, according to the method described above in the detailed description. In the test developer the compounds showed significant inhibiting properties, as can be derived from the data summarized in Table 10 hereinafter.

TABLE 10

| Compound Number | Ag-determination (AAS) after 3 m (mg/l) | Inhibition percentage |
|---|---|---|
| Blank | 12.5 | — |
| I-2 | 2.2 | 18 |
| I-3 | 2.2 | 18 |
| I-1 | 2.9 | 23 |
| I-4 | 3.3 | 26 |
| I-5 | 3.7 | 30 |
| I-6 | 4.0 | 32 |
| I-7 | 5.0 | 40 |
| Comp. 3 | 8.7 | 70 |
| Comp. 4 | 20.0 | 160 |

Comp. 3

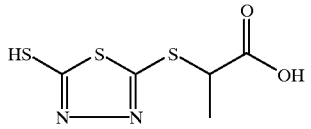

Comp. 4

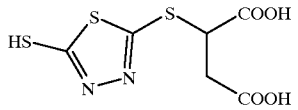

For the other chemical compounds useful as inhibitors in these experiments the structure has already been given hereinbefore.

From the results obtained it is concluded unambiguously that introducing solubilizing groups severely decreases the inhibiting properties or even transforms the compound into a compound providing silver halide solvent action.

In order to be practically useful as an inhibitor it is clear that the inhibitors may have only limited influence on sensitometry. At a concentration of 50 mg/l loss in speed of 0.10 log E(xposure) should be considered as an acceptable limit. Results obtained with respect to sensitometry (parameters of F(og), S(peed) and G(radation) defined hereinbefore) have been summarized in Table 11.

TABLE 11

| Inhibitor | mg/l | F | S | G |
|---|---|---|---|---|
| I-3 | 0 | 0.227 | 1.68 | 3.52 |
| | 50 | 0.222 | 1.73 | 3.36 |
| I-1 | 0 | 0.224 | 1.70 | 3.53 |
| | 50 | 0.219 | 1.70 | 3.34 |
| I-5 | 0 | 0.225 | 1.69 | 3.62 |
| | 50 | 0.226 | 1.69 | 3.42 |
| I-4 | 0 | 0.226 | 1.68 | 3.58 |
| | 50 | 0.224 | 1.76 | 3.12 |
| I-2 | 0 | 0.224 | 1.70 | 3.60 |
| | 50 | 0.225 | 1.71 | 3.60 |
| I-6 | 50 | 0.218 | 1.71 | 3.55 |
| I-7 | 50 | 0.220 | 1.75 | 3.58 |

From the Table 11 it can be concluded that all inhibitors classified as suitable for use in the developer composition according to the present invention have an acceptable influence on sensitometry.

Example 7

The silver complexing agents according to the present invention form soluble silver complexes and are expected to show, to a certain extent, silver ion elution properties. Said elution properties are evaluated in the same type of experiment as the evaluation of the inhibiting properties of the inhibitors (see therefore Examples 5 and 6).

Result of the silver elution experiments are summarized in Table 12. The elution percentage (% elution) is calculated from the formula % Elution=100×(mg/l of silver measured in the presence of complexing agent) :(mg/l of silver in a reference experiment)

TABLE 12

| Complexing agent | Silver content (mg/l determined by AAS) (after running 3 m) | Percentage of inhibition. |
|---|---|---|
| C-3 | 24.7 | 198% |
| C-10 | 26.8 | 214% |
| C-11 | 27.1 | 217% |
| C-2 | 57.0 | 456% |
| ref. exp. | 12.5 | — |

From Table 12 it is clear that good complexing agents have good elution properties: if compared with the percentage of inhibition in the reference experiment (ref.exp.) those agents are outstanding.

Example 8

Example 8 shows the influence of inhibitor depletion in a situation where the processing is performed by making use of a replenisher. In many cases where film processing is performed in an automatic processing apparatus, fresh developer is added on the basis of the amount of film processed (e.g. 200 ml/m2), with an optionally time and temperature related oxidation (stand-by) regeneration.

Following Table 13 is illustrative for the sensitometric influence of increasing concentrations of compound I-1 on the sensitometry of the material the composition of which has been given in Example 4 hereinbefore. The material was again developed in the test developer the composition of which has been given hereinbefore. Significance of sensitometric data given have also been explained in the Example 4 hereinbefore.

TABLE 13

| I-1 (mg/l) | F | S | G |
|---|---|---|---|
| 0 | 0.224 | 1.70 | 3.53 |
| 50 | 0.219 | 1.70 | 3.34 |
| 200 | 0.234 | 1.79 | 2.01 |
| 500 | 0.192 | >3.00 | |

The inhibitors clearly tend to show larger sensitometric effects the complexing agents in particular for concentrations above 200 mg/l.

I-1

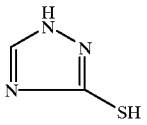

In this replenishment experiment wherein an appreciable amount of inhibitor was present (180 mg/l of inhibitor compound I-1) it has surprisingly been established that no expected remarkable decrease of the linear contrast or gradation G appears in the sensitometric curve as long as the inhibitor concentration does not rise to 200 mg/l or more. An explanation of the observed effect may be a selective depletion in the developer solution of the said inhibitor. Following Table 14 represents the sensitometric data resulting from a long-term experiment. In that experiment 120 m2 of film was processed in a prototype processor which was improved for developer oxidation and evaporation. The developer in the tank before film processing took place was the test developer described hereinbefore with addition of 110 mg/l of compound I-1 (starter developer). The processed film material was the same material as described hereinbefore. The developer replenisher solution had the same composition as the developer apart from a higher pH (10.25 instead of 9.65) and for the presence of extra 180 mg/l of compound I-1, with a replenishing rate of 165 ml/m2.

TABLE 14

| Number of m2 | F | S | G |
|---|---|---|---|
| Start | 0.265 | 1.53 | 3.38 |
| 5 | 0.257 | 1.53 | 3.58 |
| 10 | 0.253 | 1.54 | 3.58 |
| 20 | 0.250 | 1.54 | 3.43 |
| 30 | 0.255 | 1.55 | 3.52 |
| 40 | 0.268 | 1.56 | 3.40 |
| 60 | 0.283 | 1.57 | 3.16 |
| 80 | 0.259 | 1.58 | 3.07 |
| 100 | 0.261 | 1.60 | 3.13 |
| 120 | 0.271 | 1.59 | 3.05 |

On the basis of sensitometric data in fresh developers, one would expect a decrease of the contrast by addition of 180 mg/l of compound I-1 in a fresh starting developer even up to a value of about 2.00. Surprisingly this decrease does not take place and contrast does not decrease to a value below 300. This is probably caused by a selective depletion of concentration of compound I-1 in the developer solution. After analysis of the developer with respect to the amount of compound I-1 this was confirmed as has been shown in Table 15.

TABLE 15

| m2 of processed film | Compound I-1 (mg/l) in developer in tank |
|---|---|
| Starting solution | 100 |
| 5 | 79 |
| 20 | 63 |
| 40 | 33 |
| 80 | 33 |
| 120 | 25 |

Although the concentration in the replenishing solution was 180 mg/l, the actual concentration in the steady state developer was appreciably lower (25 mg/l).

Example 9

This example shows that a combination of a complexing agent and an inhibitor perform better when both of them are present. In this example the inhibition experiment was performed using the test developer containing moreover a combination of complexing agent C-1 and inhibitor I-3.

Sample 1 should be considered as comparative example as no complexing agent and no inhibitor were added.

In the development of samples 2 and 3, only inhibiting or complexing agent are added respectively and as such also these examples should be considered as comparative examples.

Silver levels were measured immediately after processing. The sludge level was visually examined, immediately after the processing. Samples having cloudiness or precipitation are judged to be not O.K. (indicated in the Table 16 as "NOK"); samples having no sludge are considered to be "OK".

It is clear from the said Table 16 that, in particular, a combination of a complexing agent (C-1) and an inhibitor (I-3) perform well with respect to the prevention of silver sludge.

TABLE 16

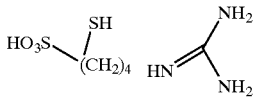

C-1

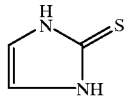

I-3

| Sample No. | | I-3 (mg/l) | C-1 (mg/l) | Silver level (mg/l) | Sludge |
|---|---|---|---|---|---|
| 1 | comp | 0 | 0 | 30.2 | NOK |
| 2 | comp | 200 | 0 | 7.9 | NOK |
| 3 | comp | 0 | 200 | 76.1 | NOK |
| 4 | inv | 200 | 200 | 37.6 | OK |
| 5 | inv | 200 | 600 | 2.7 | OK |
| 6 | inv | 600 | 200 | 14.5 | OK |
| 7 | inv | 600 | 600 | 5.2 | OK |

As is clear from the present experiment combination of an inhibitor compound as the one according to the formula I-3 and a silver complexing agent as C-1 leads to an improvement in avoiding sludge formation in the developer, the more when the silver complexing agent is present in an excessive amount versus the amount of inhibitor. (see low silver level for ratio amounts by weight of 3:1; as can be expected higher ratio amounts will make perform the system even better, although higher absolute amounts of inhibitor have a suppressing effect on silver level as well).

Example 10

This example shows that a combination of a complexing agent and an inhibitor perform better when they are both present. In this example the inhibition experiment was performed making use of the same test developer as in the Examples hereinbefore and making use a combination of complexing agent C-1 and inhibitor I-2. Sample 1 was a comparative example, where no complexant and no inhibitor were add. In samples 2 and 3, only inhibitor and complexing agent were added respectively and these samples should thus be considered as comparative samples too. The silver levels were measured immediately after processing. The sludge level was visually judged immediately after the processing. Samples showing sludge (cloudiness or precipitates) were judged to be not OK ("NOR") as has been made clear the Table 17.

TABLE 17

| Sample No. | | I-2 (mg/l) | C-1 (mg/l) | Silver level (mg/l) | Sludge |
|---|---|---|---|---|---|
| 1 | comp | 0 | 0 | 30.2 | NOK |
| 2 | comp | 200 | 0 | 8.6 | NOK |
| 3 | comp | 0 | 200 | 76.1 | NOK |
| 4 | inv | 200 | 100 | 16.8 | OK |
| 5 | inv | 200 | 300 | 20.7 | OK |
| 6 | inv | 200 | 600 | 17.2 | OK |
| 7 | inv | 300 | 100 | 3.9 | OK |
| 8 | inv | 300 | 300 | 6.5 | OK |
| 9 | inv | 300 | 600 | 13.9 | OK |
| 10 | inv | 500 | 100 | 1.1 | OK |

As in the previous Example 9, it appears from the Table 17 above that the combination of an inhibitor and a complexing agent provides superior results, compared with the separate use of complexing agent or inhibitor.

An inhibitor used separately actually makes decrease the silver content in the developer but due to the absence of a complexing agent the (low amount of) silver readily precipitates and gives rise to sludge formation.

A complexing agent tends to stabilize silver ions, but when too high amounts of silver are eluted, the concentration of complexing agent is not high enough to provide enough complexation and resulting anti-sludge action. Additional increase of the concentration of complexing agent will further make the amount of washed out silver increase.

Sludge results after 1 week leaving unstirred the developer solutions used were judged to be identical. Experiments wherein both complexing agent and inhibitor were used together were OK, whereas the others were not. On the longer term of weeks and even months it appeared that the samples 6 and 9 tend to form precipitates more readily than the other inventive examples (which was still appreciably better than it was for the comparative examples). It was thought that this was due to the relatively high amount of silver in the developer, while the concentration of complexing agent was relatively low (e.g. compared to sample 8, having a high silver level, but also containing a higher amount of complexing agent.

C-1

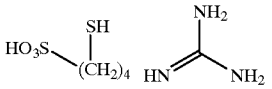

I-2

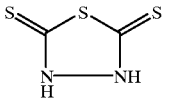

It has thus been affirmed that a combination of a silver complexing agent and an inhibitor as presented in the present Example has a positive influence on sludge formation in the developer, even for a long period of time as presented herein.

Example 11

Preferred complexing agent/inhibitor combinations were tested in a processing experiment. The processor used was a Fuji Cepros-P processor. The developer starting solution was the same as the test developer given hereinbefore with in addition thereto 300 mg/l of inhibiting compound I-2 and 300 mg/l of complexing compound C-1. The replenishing solution had following composition.

TABLE 22

Composition of the developer replenisher.

| Components of developer | Amount |
|---|---|
| Demineralized water | 700 ml |
| Potassium metabisulfite | 46 g |
| Hydroxyethyldiphosphonic Acid (60%) | 1.8 ml |
| Trilon B | 8 ml |
| Sodium erythorbate.aq | 140.0 g |
| Potassium thiocyanate | 2 g |
| 2-Methyl-benztriazole | 60 mg |
| 4,4'-hydroxymethyl-methyl-1-phenyl-3-pyrazolidine-1-one | 5.5 g |
| Potassium carbonate | 175 ml |
| C-1 | 0.6 g |
| I-2 | 0.6 g |

Density: 1.215; pH = 10.55 (adjusted with potassium hydroxide)

120 m2 of film were processed over a period of 2 weeks. The replenishing amount was approximately 165 ml/m2 of a ready-for-use solution. The developer was provided as a concentrate (1+1) in order to achieve the desired developer composition after dilution in the processor. The hardener free fixer concentrate described hereinbefore was used.

A film material having {111} tabular silver bromo(iodide) grains was prepared as follows. Emulsions comprising said grains were prepared as follows.

To a solution of 5.5 g of an oxidized gelatin in 3 l of demineralized water at 51° C., adjusted to a pH of 2.5 by adding $H_2SO_4$, stirred up to a rate of 600 r.p.m., were added by a double jet method aqueous solutions of 1.96 M $AgNO_3$ (hereinafter referred to as A1) and 1.96 M KBr (hereinafter referred to as B1): 16 ml of A1 and 16 ml of B1 were added in a time interval of 30 seconds. During this period, the reaction mixture was maintained at 51° C. When the addition was completed, stirring continued during 60 seconds, UAg was measured (normal value 28 mV±5 mV vs. a Ag/AgCl(sat.) reference electrode and 6 minutes later, temperature was increased up to 70° C. over a period of 25 minutes: UAg was controlled again and should be in the range from 40.1±5 mV at a temperature of 70° C.±1° C. 6 minutes later pH was set to a value of 5.0±0.3 and immediately thereafter a solution of 50 g of inert gelatin in 500 ml of demineralized water of 70° C. was added. 330 seconds later B1 was added at a rate of 7.5 ml/min. during 148 seconds, followed during 1 minute by the simultaneous addition of A1 (at a rate of 7.5 ml/min.) and B1 (at a rate of 7.6 ml/min.) during 60 seconds. In a further double jet addition A1 and B1 were added during 2675 seconds at a linearly increasing rate going from 7.5 up to 15 ml/min. for A1 and from 7.6 up to 15.21 ml/min. in order to maintain a constant UAg potential of +10 mV in the reaction vessel. After 5 minutes A1 was added during 263 seconds at a rate of 7.5 ml/min. in order to increase the UAg value to 60 mV. At that moment a further double jet addition was performed for 100 seconds at a rate of 7.5 ml/min., whereafter the rate was increased linearly during 2518 seconds up to 36.8 ml/min. for A1 and up to 36.73 ml/min. for B1 in order to hold a constant UAg potential of +60 mV in the reaction vessel. When said double jet addition was running 4 minutes an amount of an emulsion, dissolved in 20 g of demineralized water at 40° C., having ultrafine (ca. 0.050 μm) 100% AgI crystals was added to the reaction vessel in order to get a total AgI content at the end of precipitation of 1 mole % vs. silver precipitated.

After a physical ripening time of 20 min. stirring was ended in the reaction vessel. The average grain size of the silver bromoiodide tabular {111} emulsion grains thus prepared, expressed as equivalent volume diameter, was 0.57 μm, the average thickness was 0.16 μm.

After washing, gelatin and water were added in order to obtain a silver halide content of 236 g/kg, expressed as $AgNO_3$, and a gelatin content of 74 g/kg. To 3370 g of this emulsion, of which pH was adjusted to 5.5, were added consecutively 4 ml of a 10 wt. % KSCN solution, 0.2 ml of a $4.76\times10^{-3}$ M solution of sodium toluenethiosulphonate in methanol, 18 ml of compound (V)(0.4 wt %) followed by addition after 30 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, 7 mg of sodium thiosulphate (0.1 wt. %), 8 ml of a 0.001 wt. % solution of compound (IV) (2-carboxyethyl-N-benzothiazine selenide), 15 ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole (compound VI) and this mixture was chemically ripened during 4 hours at 50° C. After cooling, a preservative was added.

(IV)

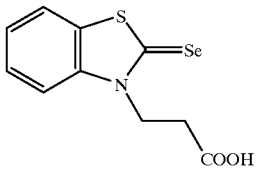

(V)

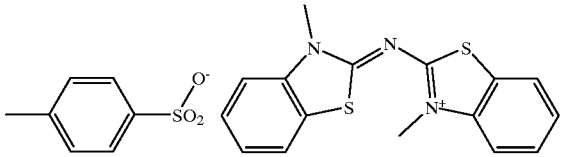

-continued (VI)

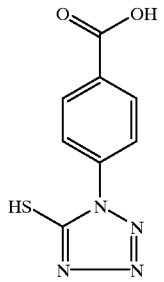

The film material comprising the emulsions prepared hereinbefore was prepared and coated as follows. Before coating each emulsion was stabilized with 1-p-carboxyphenyl-5-mercapto-tetrazole and after addition of the normal coating additives the solutions were coated simultaneously together with a protective layer containing 1.3 g gelatine per $m^2$ per side on both sides of a polyethylene terephthalate film support having a thickness of 175 $\mu$m.

Samples of these coatings were exposed with green light of 540 nm during 0.1 seconds using a continuous wedge and were processed The processing was run in the developer, the composition of which has been given hereinbefore in Table 3—see Example 1, followed by fixing in fixer, the composition of which has been given hereinbefore in Table 7—see Example 4, and rinsing at the indicated temperature of 35° C. for a total processing time of 60 s.

Following Table 19 represents the silver level in the developer solution in the processor tank as well as the visually observed sludging level. From the said Table 19 it becomes clear that even after running a substantial amount of film, there is little silver deposit in the developer solution in the tank and sludge level is judged to be excellent (++). Examination of the developer solution one week later is confirming the results with respect to sludge as they remain excellent.

TABLE 19

| Film in m2 | [Ag] DEV mg Ag/l | Sludging |
|---|---|---|
| 0 $m^2$ | 0.3 | ++ |
| 1 $m^2$ | 0.7 | ++ |
| 5 $m^2$ | 0.9 | ++ |
| 10 $m^2$ | 1.0 | ++ |
| 20 $m^2$ | 1.0 | ++ |
| 30 $m^2$ | 1.0 | ++ |
| 40 $m^2$ | 1.1 | ++ |
| 60 $m^2$ | 0.8 | ++ |
| 75 $m^2$ | 0.6 | ++ |
| 90 $m^2$ | 0.7 | ++ |
| 105 $m^2$ | 0.8 | ++ |
| 120 $m^2$ | 0.9 | ++ |

++: excellent (= low level of sludging)

Example 12

Following experiment was performed using the developer G135, trademarked product from Agfa-Gevaert N.V., with the addition of 100 mg/l of inhibiting compound I-1 and 650 mg/l of complexing compound C-1. The experiment was performed according to the description in Example 5, using non-destructive film material STRUCTURIX D7, trademarked product from Agfa-Gevaert, having huge coating amounts of silver (symmetrical double-side coated material coated at a silver amount, equivalent with 26 g of silver nitrate per square meter and per side) . Following Table 20 lists the silver levels after 3 m and 6 m of highly silver coated film have been processed. Without addition of complexing and inhibiting compounds precipitation is formed in the developer within one hour (comp.). When both compounds are added (inv.), sludging is postponed.

TABLE 20

| Developer | Total silver amount (mg/l) 3 m | 6 m | Time of occurrence of silver precipitation |
|---|---|---|---|
| G135 ® (comparative) | 9.6 | 19.0 | After 1 hour |
| G135 ® + 100 mg I-2 + 650 mg C-1/1 | 4.7 | 10.9 | After 3 days |

Example 13

The present example is similar with Example 12. It is illustrative for a comparison made between a material rich in silver bromide (AgBr-Film) as described in Example 12 and a material material rich in silver chloride (AgCl-Film) described in Example 4, when both materials are developed in the test developer the composition of which has been given in the same Example 4 and wherein said developer contains ascorbic acid as main developing agent. Additives added thereto have been given in the Table 21 given hereinafter.

TABLE 21

| Developer | Ag-contents 3 m | 6 m | Sludge occurrence |
|---|---|---|---|
| AgCl-Film (comp.) | 12.5 | 30.2 | After 1 hour |
| AgCl-Film + 300 mg I-2/300 mg C-1/1 | 1.2 | 2.4 | >3 weeks |
| AgBr-Film (comp.) | 7.6 | 13.0 | After 1 hour |
| AgBr-Film + 300 mg I-2/300 mg C-1/1 | 0.7 | 1.2 | >3 weeks |

As can be concluded from Table 21 the AgBr-film is superior with respect to sludging if compared with the material rich in silver chloride. The addition of the preferred complexing agent and of the preferred inhibitor provides a substantial improvement in both cases.

What is claimed is:

1. Black-and-white silver halide developer composition, said composition comprising, besides one or more developing agent(s), agent(s) preventing oxidation thereof and agent (s) providing pH buffering, at least one silver complexing agent, characterized in that said silver complexing agent has a silver complexing stability ratio of at least 70%, wherein said silver complexing stability is determined after dissolving 50 mg of the said complexing agent in 200 ml of said developer composition, adding thereto under constant vigorous stirring 74 ml of a solution of silver nitrate having a concentration of 0.0005 moles/liter, adding over a period of 30 minutes said solution to the said developer solution thereby providing a total amount of added silver expressed as an equivalent amount of silver nitrate of 15 mg/l, leaving said solution unstirred in order to provide an equilibrium state between formed precipitate and supernatant developer liquid and measuring the silver content in the said supernatant liquid after 3 weeks; wherein said complex stability ratio is calculated as ratio of silver content in supernatant liquid to total amount of silver added; and at least one agent preventing silver dissolution, characterized in that said agent preventing silver dissolution, if present in an amount of 50 mg/l of developer, makes silver content of the developer decrease in an amount of more than 50% versus in the absence thereof, without loss in speed in an amount of more than 0.10 log Exposure after processing in said developer composition.

2. Developer composition according to claim 1, wherein said complexing agent makes silver content of the said developer in running equilibrium conditions increase in an amount of more than 1 mg per liter per mmole of said complexing agent.

3. Developer composition according to claim 1, wherein said developing agent(s) is(are) selected from the group consisting of hydroquinone, 1-ascorbic acid, iso-ascorbic acid, reductic acid, 1-phenyl-3-pyrazolidine-1-ones (phenidones), salts and derivatives thereof.

4. Developer composition according to claim 1, wherein said silver completing agent is corresponding to the general formula (I)

MS—L—X (I)

wherein

L is a divalent linking group;

M is selected from the group consisting of hydrogen, S—L—X, a group providing a thiolate anion under alkaline processing conditions and a charge compensating counterion for the said thiolate anion;

X is an acidic solubilizing group having a $pK_a$ of 7 or less or a salt thereof.

5. Developer composition according to claim 4, wherein, in the general formula (I), MS— is linked to an aliphatic carbon atom.

6. Developer composition according to claim 1, wherein said agent preventing silver salt dissolution corresponds to the general formula (II)

(II)

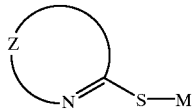

wherein Z represents atoms necessary to form a 5- or 6-membered hetero-aromatic ring, provided that the said hetero-aromatic ring is not substituted by a solubilizing group having a $pK_a$ of 7 or less, and M is selected from the group consisting of hydrogen, a group providing a thiolate anion under alkaline processing conditions and a charge compensating counterion for the said thiolate anion.

7. Developer composition according to claim 6, wherein the said hetero-aromatic ring is a 5-membered hetero-aromatic ring.

8. Developer composition according to claim 6, wherein the said hetero-aromatic ring is selected from the group consisting of triazoles, thiadiazoles, imidazoles and benzimidazoles.

9. Developer composition according to claim 1, wherein, in running equilibrium conditions, a molar ratio of silver completing agent to silver is more than 10:1.

10. Developer composition according to claim 1, wherein said silver completing agent(s) is(are) present in a concentration between 10 and 2000 mg/l.

11. Developer composition according to claim 1, wherein as an agent preventing oxidation sulfite is present in a free sulfite concentration below 0.4 M.

* * * * *